US010918206B1

(12) United States Patent
Bewley, Jr. et al.

(10) Patent No.: US 10,918,206 B1
(45) Date of Patent: Feb. 16, 2021

(54) SPACEMAKER FOR AN UNDER-SINK DISPOSAL

(71) Applicant: Haier US Appliance Solutions, Inc., Wilmington, DE (US)

(72) Inventors: Wilbur Carl Bewley, Jr., Nicholasville, KY (US); Jason Allen Rowe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/815,750

(22) Filed: Mar. 11, 2020

(51) Int. Cl.

| | |
|---|---|
| ***A47B 77/02*** | (2006.01) |
| ***A47B 96/06*** | (2006.01) |
| *A47B 77/04* | (2006.01) |
| *E03C 1/182* | (2006.01) |

(52) U.S. Cl.
CPC ..... *A47B 77/02* (2013.01); *A47B 96/06* (2013.01); *A47B 77/04* (2013.01); *E03C 1/182* (2013.01)

(58) Field of Classification Search
CPC ..... A47B 77/02; A47B 96/06; A47B 77/04; E03C 1/182
See application file for complete search history.

(56) References Cited

U.S. PATENT DOCUMENTS 1,885,092 A * 10/1932 Fellerman ..... B67D 1/06 312/140.1
1,897,717 A * 2/1933 Appel ..... A47B 13/16 108/26
4,826,007 A * 5/1989 Skeie ..... A63H 33/30 206/373
4,847,927 A * 7/1989 Blanc ..... B65F 1/0066 4/629
485,458 A 8/1989 Koch et al.
4,895,418 A * 1/1990 Medellin ..... B67D 1/06 108/38
5,292,028 A * 3/1994 Patterson ..... A47G 19/065 206/217
5,303,500 A * 4/1994 Luukonen ..... A01K 97/01 206/315.11
5,372,827 A * 12/1994 Brauner ..... B65D 21/0238 206/216
5,704,078 A * 1/1998 Chandler ..... A47K 11/02 4/449

(Continued)

FOREIGN PATENT DOCUMENTS

JP 2019010600 A 1/2019

OTHER PUBLICATIONS

The Container Store, Iris Expandable Under Sink Organizer, https://www.containerstore.com/s/kitchen/cabinet-organizers/expandable-under-sink-organizer/12d?productId=10035752#, 1 page.

(Continued)

*Primary Examiner* — Ko H Chan
(74) *Attorney, Agent, or Firm* — Dority & Manning, P.A.

(57) ABSTRACT

A spacemaker includes a sheath that defines an interior volume. The interior volume of the sheath is sized such that an under-sink disposal is receivable within the interior volume of the sheath. A plurality of mounting flanges is mounted to the sheath at a top portion of the sheath. The plurality of mounting flanges is configured for engaging a mounting flange of the under-sink disposal. A shelf is mounted to the sheath at a bottom portion of the sheath.

19 Claims, 15 Drawing Sheets

(56) References Cited

U.S. PATENT DOCUMENTS

| | | | | | |
|---|---|---|---|---|---|
| 5,984,131 | A * | 11/1999 | Krueger | A47G 19/065 | 220/23.83 |
| 6,158,580 | A * | 12/2000 | Davis | B65D 25/205 | 206/0.81 |
| 6,726,296 | B2 | 3/2004 | McGilton | | |
| 6,880,470 | B2 * | 4/2005 | Sidor | A47B 77/18 | 108/25 |
| 7,896,037 | B2 * | 3/2011 | Alsberg | B67D 3/0029 | 141/174 |
| 8,186,538 | B2 * | 5/2012 | MacCarthy | A47G 19/065 | 206/217 |
| D719,787 | S * | 12/2014 | Seegars | D7/553.6 | |
| 9,474,398 | B1 * | 10/2016 | Farmer | B65D 1/36 | |
| 2007/0151018 | A1 * | 7/2007 | Palkon | E03C 1/04 | 4/630 |
| 2013/0002100 | A1 | 1/2013 | Badri | | |
| 2015/0369471 | A1 | 12/2015 | Williams | | |
| 2018/0073229 | A1 * | 3/2018 | Nahum | E03C 1/1222 | |

OTHER PUBLICATIONS

Mr. Scrappy Unique Disposer, Kitchen, and Home Products, Disposer Parts (3-Bolt), https://www.containerstore.com/s/kitchen/cabinet-organizers/expandable-under-sink-organizer/12d?productId=10035752#, 5 pages.

* cited by examiner

SPACEMAKER FOR AN UNDER-SINK DISPOSAL

FIELD OF THE INVENTION

The present subject matter relates generally to under-sink storage.

BACKGROUND OF THE INVENTION

Disposals are frequently mounted to sinks and are operable to grind and/or shred food waste from the sinks. Such disposals are frequently mounted to a sink by a bracket that is connected to a drain of the sink. The disposal is coupled to the bracket and extends downwardly from the sink.

While offering valuable food waste disposal functionality, disposals have drawbacks. For example, disposals can extend downwardly into a cabinet below the sink and occupy valuable storage space in the cabinet. Tall items, such as cleaning liquid containers, in the cabinets generally cannot be stored directly underneath the disposals.

According, devices for increasing storage below sinks with disposals would be useful.

BRIEF DESCRIPTION OF THE INVENTION

Aspects and advantages of the invention will be set forth in part in the following description, or may be apparent from the description, or may be learned through practice of the invention.

In a first example embodiment, a spacemaker includes a sheath that defines an interior volume. The interior volume of the sheath is sized such that an under-sink disposal is receivable within the interior volume of the sheath. A plurality of mounting flanges is mounted to the sheath at a top portion of the sheath. The plurality of mounting flanges is configured for engaging a mounting bracket of the under-sink disposal. A shelf is mounted to the sheath at a bottom portion of the sheath.

In a second example embodiment, a spacemaker includes a sheath that defines an interior volume. The interior volume of the sheath is sized such that an under-sink disposal is receivable within the interior volume of the sheath. A plurality of mounting flanges is mounted to the sheath at a top portion of the sheath. Each of the plurality of mounting flanges extends radially inward from the sheath. A shelf is mounted to the sheath at a bottom portion of the sheath. A bottom wall of the shelf extends radially outward from the sheath. The sheath, the plurality of mounting flanges, and the shelf are integrally formed from a single piece of plastic.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
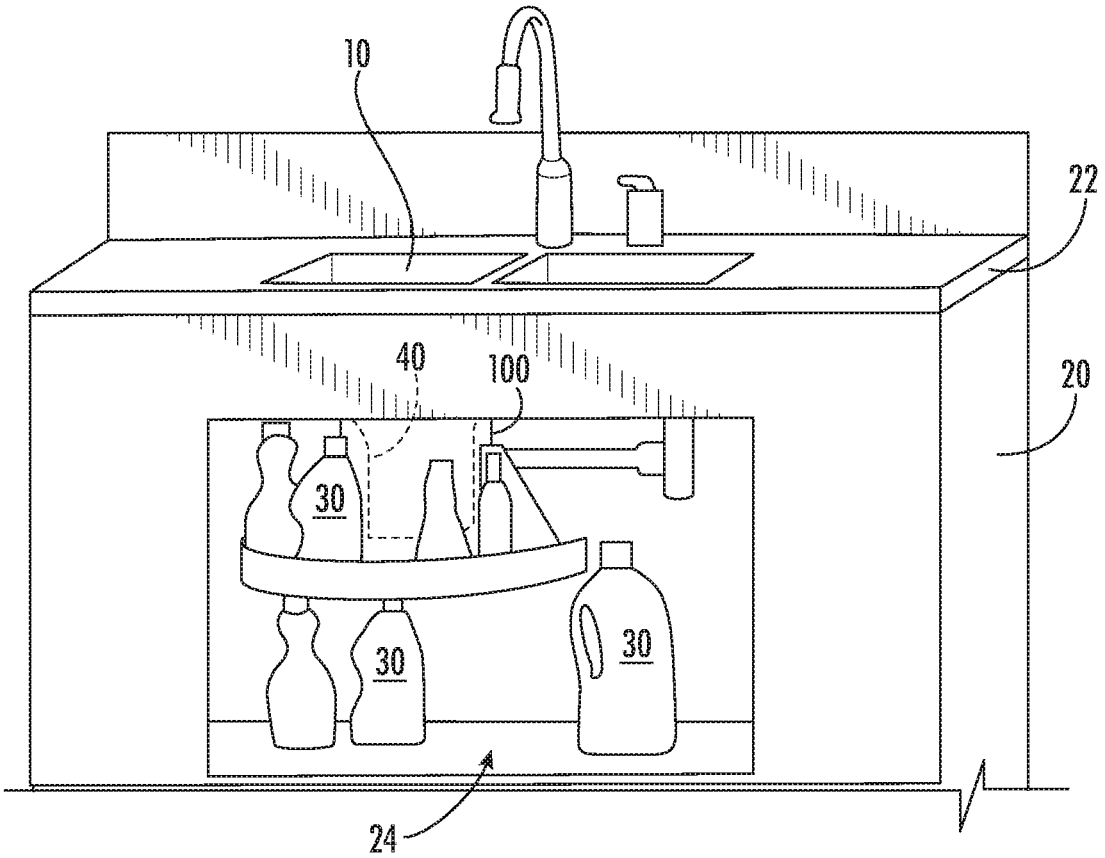
FIG. 1 is a perspective view of a sink mounted on a cabinet and a spacemaker, according to an example embodiment of the present subject matter, installed on a disposal mounted to the sink within the cabinet.
Figure 2:
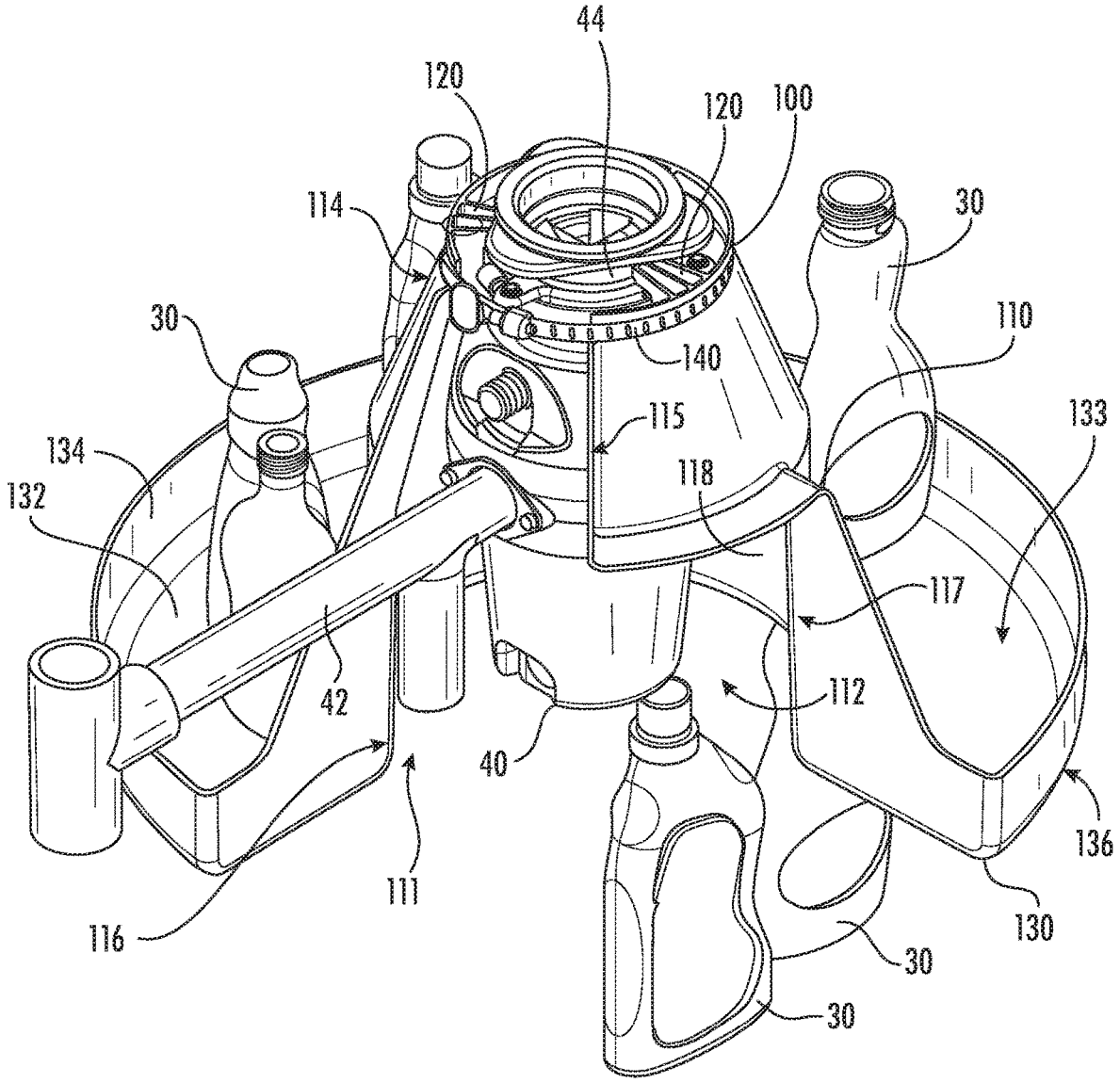
FIG. 2 is a rear perspective view of the example spacemaker of FIG. 1 mounted on a disposal.
Figure 3:
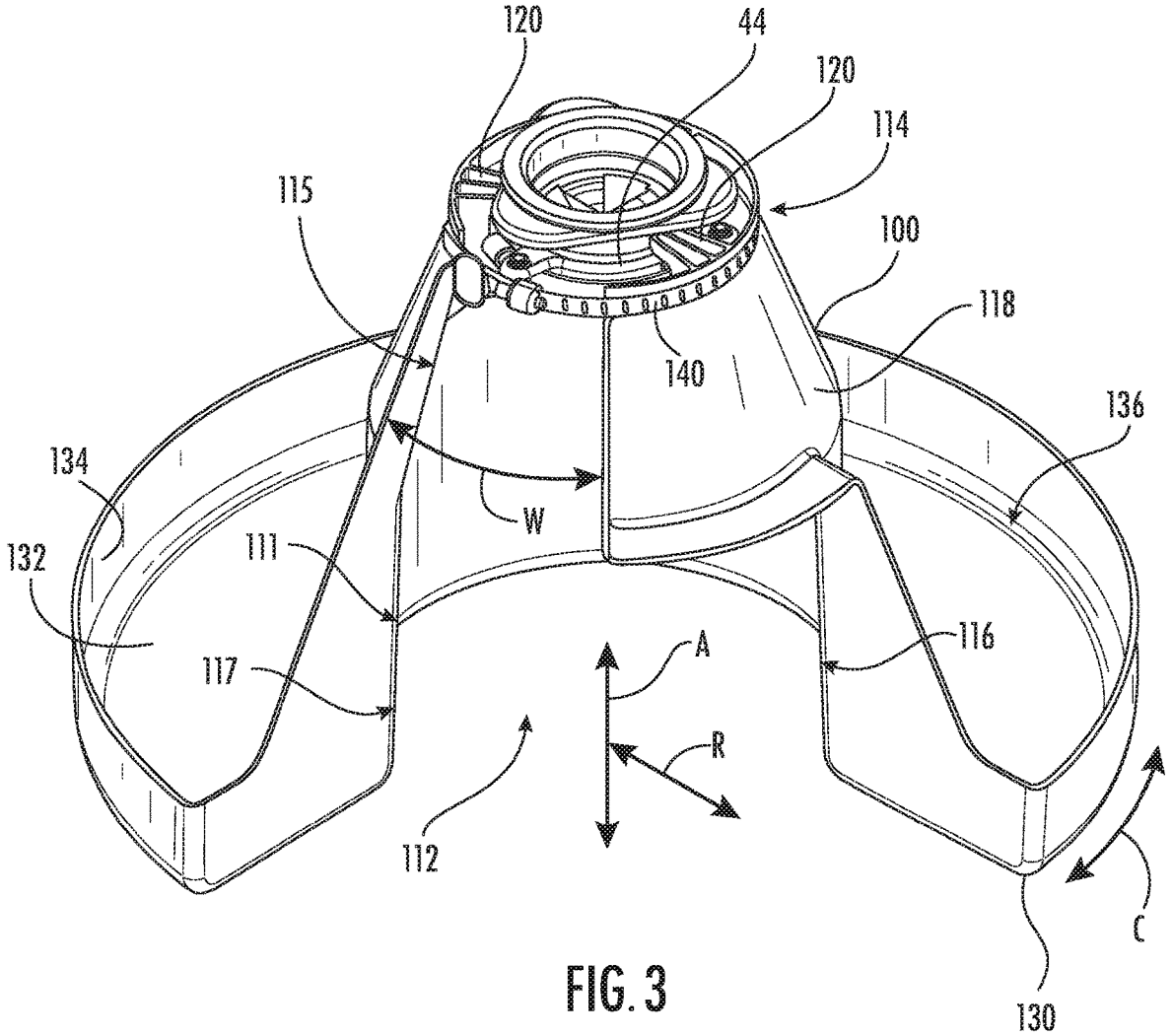
FIG. 3 is a rear perspective view of the example spacemaker of FIG. 1 and a mounting bracket of the disposal.
Figure 4:
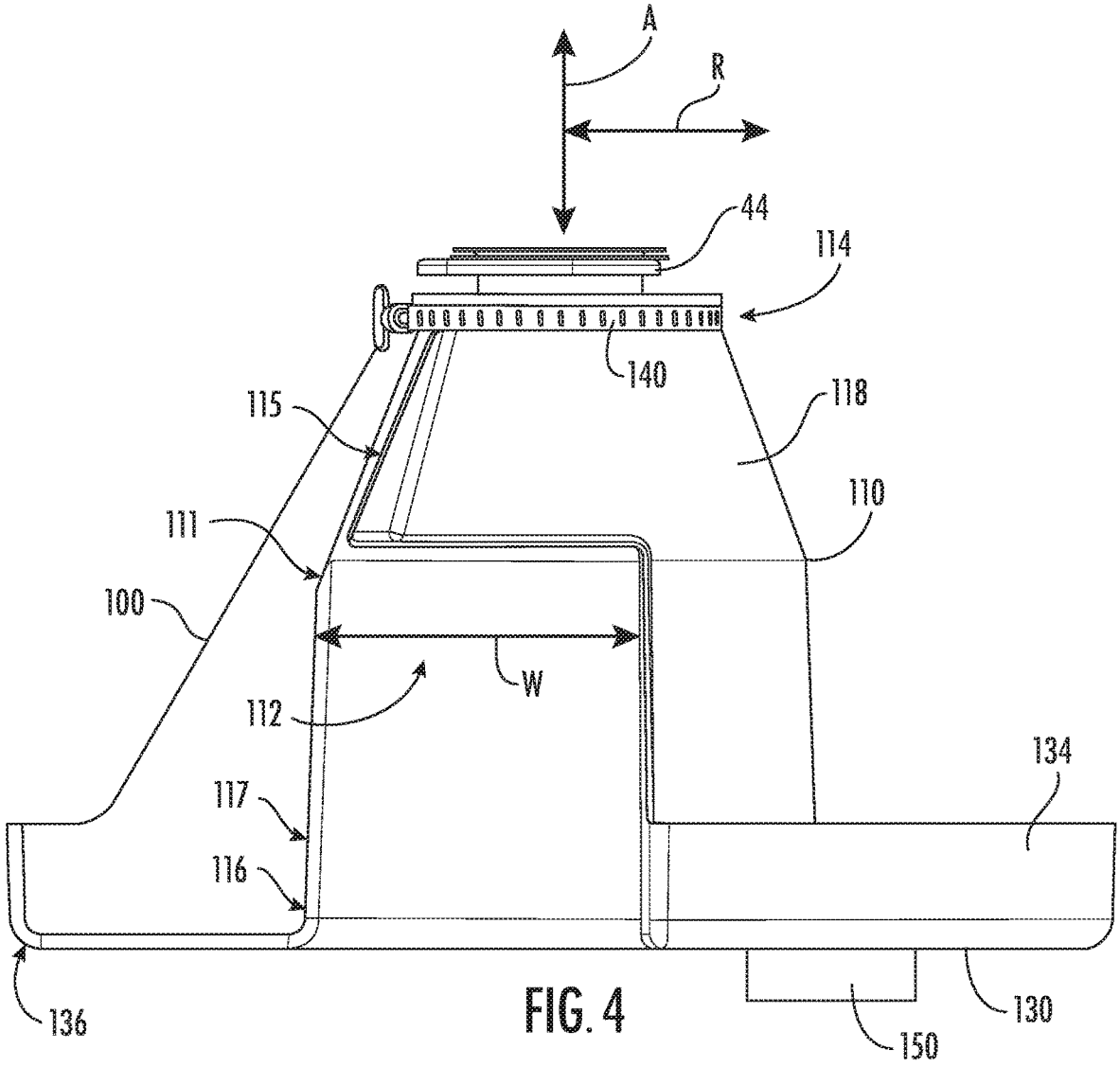
FIG. 4 is a side elevation view of the example spacemaker of FIG. 1 and the mounting bracket of the disposal.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a sink 10 mounted on a cabinet 20. As shown in FIG. 1, sink 10 may be position on and/or mounted to a countertop 22 of cabinet 20. Cabinet 20 may have a storage area 24 below sink 10 and/or countertop 22. One or more doors (not shown) may be mounted to cabinet 20 to provide selective access to storage area 24. A user may open the door(s) to access storage area 24, e.g., in the manner shown in FIG. 1. Various articles may be positioned and stored within storage area 24. For example, a user may position supplies 30, such as bleach, dishwasher detergent, soap, etc., within storage area 24. Thus, storage area 24 provides a convenient location for keeping items within cabinet 20.

A disposal 40 may be mounted to sink 10. In particular, disposal 40 may be mounted to a bottom of sink 10, e.g., at a drain of sink 10, and extend downwardly from sink 10 into storage area 24. Thus, disposal 40 occupies valuable space within storage area 24. Some of cleaning supplies 30 may be too tall to store beneath disposal 40. A spacemaker 100 mounted to disposal 40 within storage area 24 provides storage features for cleaning supplies 30 and other items within storage area 24. Thus, spacemaker 100 may advantageously reduce the inconvenience of the storage space reduction caused by disposal 40 in storage area 24. Various example features of spacemaker 100 are discussed in greater detail below in the context of FIGS. 2 through 8.

With reference to FIGS. 2 through 8, spacemaker 100 may include a sheath 110. Sheath 110 is configured for receipt of disposal 40. For example, sheath 110 may define an interior volume 112, and interior volume 112 of sheath 110 may be sized for receipt of disposal 40. Thus, disposal 40 may be positioned within sheath 110 when spacemaker 100 is mounted to disposal 40. As an example, sheath 110 may extend at least partially around disposal, e.g., along a circumferential direction C.

Sheath 110 may extend between a top portion 114 and a bottom portion 116, e.g., along an axial direction A. Sheath 110 may have an arcuate cross-section, e.g., in a plane that is perpendicular to the axial direction A. For instance, sheath 110 may have an arcuate side wall 118. A cross-section of arcuate side wall 118 at top portion 114 of sheath 110, e.g., in a plane that is perpendicular to the axial direction A, may taper along the axial direction A. Conversely, the cross-section of arcuate side wall 118 at bottom portion 116 of sheath 110, e.g., in a plane that is perpendicular to the axial direction A, may be uniform along the axial direction A.

Sheath 110 may also define a slot 111. Slot 111 may extend between top and bottom portions 114, 116 of sheath 110, e.g., along the axial direction. Thus, interior volume 112 of sheath 110 may be open and accessible between top and bottom portions 114, 116 of sheath 110 through slot 111. Interior volume 112 of sheath 110 may also be open at top and bottom portions 114, 116 of sheath 110.

Slot 111 may be sized to facilitate access to interior volume 112 of sheath 110 through slot 111. For example, slot 111 may have a width W along the circumferential direction C. The width W of slot 111 may be no less than about twenty degrees (20°)and no greater than about one hundred and eighty degrees (180°), e.g., no greater than about one hundred degrees (100°). As used herein, the term "about" means within ten degrees(10°) of the stated angle when used in the context of angles. Such sizing of slot 111 may advantageously allow insertion of disposal 40 into interior volume 112 of sheath 110 via slot 111, e.g., while also enclosing a substantial portion of disposal 40 in sheath 110. Such sizing of slot 111 may also allow a drain pipe 42 from disposal 40, a dishwasher drain line, an electrical wire for disposal 40, etc. to extend through sheath 110 at slot 111. Slot 111 may extend, e.g., along a circumferential direction C, between opposite edges of arcuate side wall 118.

Slot 111 may also have a first portion 115 and a second portion 117, e.g., that are spaced apart along the axial direction A. First portion 115 of slot 111 may be positioned at top portion 114 of sheath 110, and second portion 117 of slot may be positioned at bottom portion 116 of sheath 110. As may be seen from the above, first portion 115 of slot 111 may be positioned above second portion 117 of slot 111, e.g., along the axial direction A. As an example, the width W of first portion 115 of slot 111 may be no greater than about one hundred and eighty degrees(180°), and the width W of second portion 117 of slot 111 may be no greater than about one hundred and eighty degrees (180°). In particular, the width W of first portion 115 of slot 111 may be about forty-five degrees (45°), and the width W of second portion 117 of slot 111 may be about ninety degrees (90°). Such sizing of slot 111 may also allow a drain pipe 42 from disposal 40, a dishwasher drain line, an electrical wire for disposal 40, etc. to extend through sheath 110 at slot 111. Such sizing of slot 111 may advantageously allow insertion of disposal 40 into interior volume 112 of sheath 110 via slot 111 and/or allow drain pipe 42 from disposal 40, the dishwasher drain line, the electrical wire for disposal 40, etc. to extend through sheath 110 at slot 111, e.g., while also allowing sheath 110 to rotate on disposal 40. As another example, the width W of second portion 117 of slot 111 may be about forty-five degrees (45°).

Spacemaker 100 may also include a plurality of mounting flanges 120. Mounting flanges 120 are positioned at and/or mounted to sheath 110, e.g., at top portion 114 of sheath 110. Mounting flanges 120 may extend inward, e.g., along the radial direction R, from sheath 110. Mounting flanges 120 are configured for engaging a mounting bracket 44 of disposal 40. Mounting bracket 44 may be any suitable mounting bracket, such as a three-bolt mounting bracket, a four-bolt mounting bracket, etc. By mounting spacemaker 100 to mounting bracket 44, e.g., rather than another component of disposal 40, spacemaker 100 may be fixed relative to sink 10. In particular, because mounting bracket 44 is fixed to sink 10 and spacemaker 100 is mounted to mounting bracket 44, vibration transfer from disposal 40 to spacemaker 100 may be advantageously reduced, e.g., relative to mounting spacemaker 100 to some other component of disposal 40. Accordingly, items may be more securely stored on spacemaker 100, e.g., with a reduced chance of shaking off spacemaker 100.

As may be seen from the above, top portion 114 of sheath 110 may be positioned at mounting bracket 44 when spacemaker 100 is mounted to disposal 40. Conversely, bottom portion 116 of sheath 110 may be spaced from mounting bracket 44, e.g., along the axial direction A. As an example, sheath 110 may extend along the axial direction A such that bottom portion 116 of sheath 110 is flush with or positioned below a bottom of disposal 40.

Mounting flanges 120 may advantageously allow attachment of spacemaker 100 to disposal 40 at mounting bracket 44 in any orientation. For example, an installer may slide spacemaker 100 onto disposal 40 at slot 111 such that mounting flanges 120 engages mounting bracket 44. Slot 111 and/or the spacing of mounting flanges 120 may allow the installer to rotate spacemaker 100 to any suitable orientation relative to disposal 40 and then slide spacemaker 100 onto disposal 40 at slot 111. In addition, when spacemaker 100 is mounted on disposal 40 at mounting bracket 44, mounting flanges 120 may be configured to mount spacemaker 100 onto disposal 40 such that spacemaker 100 is rotatable relative to disposal 40.

Figure 5:
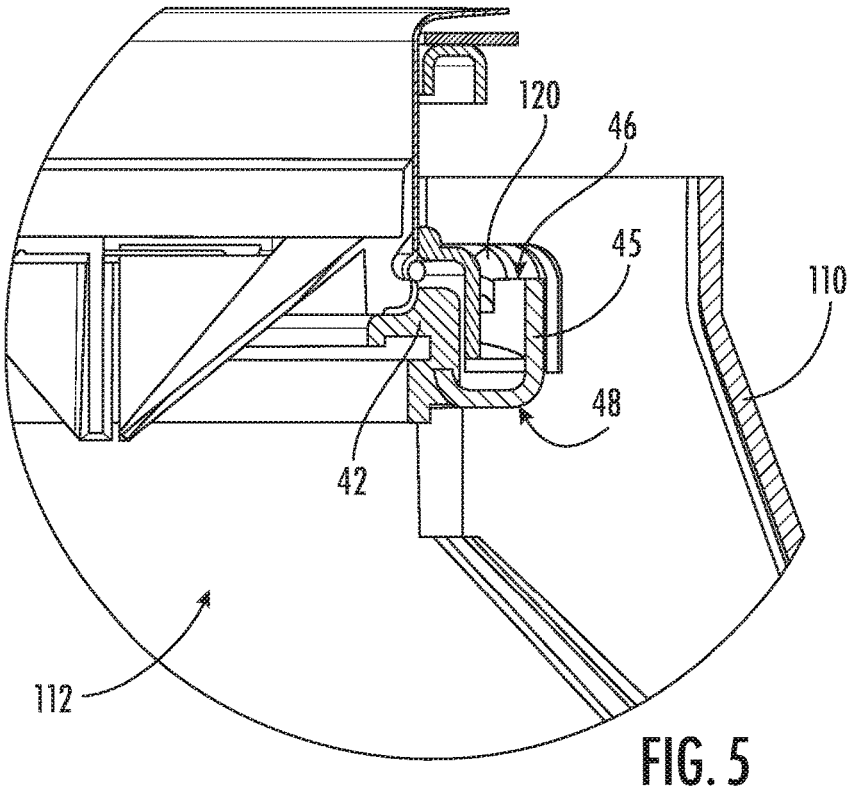
FIG. 5 is a partial section view of the mounting bracket of the disposal.
Figure 6:
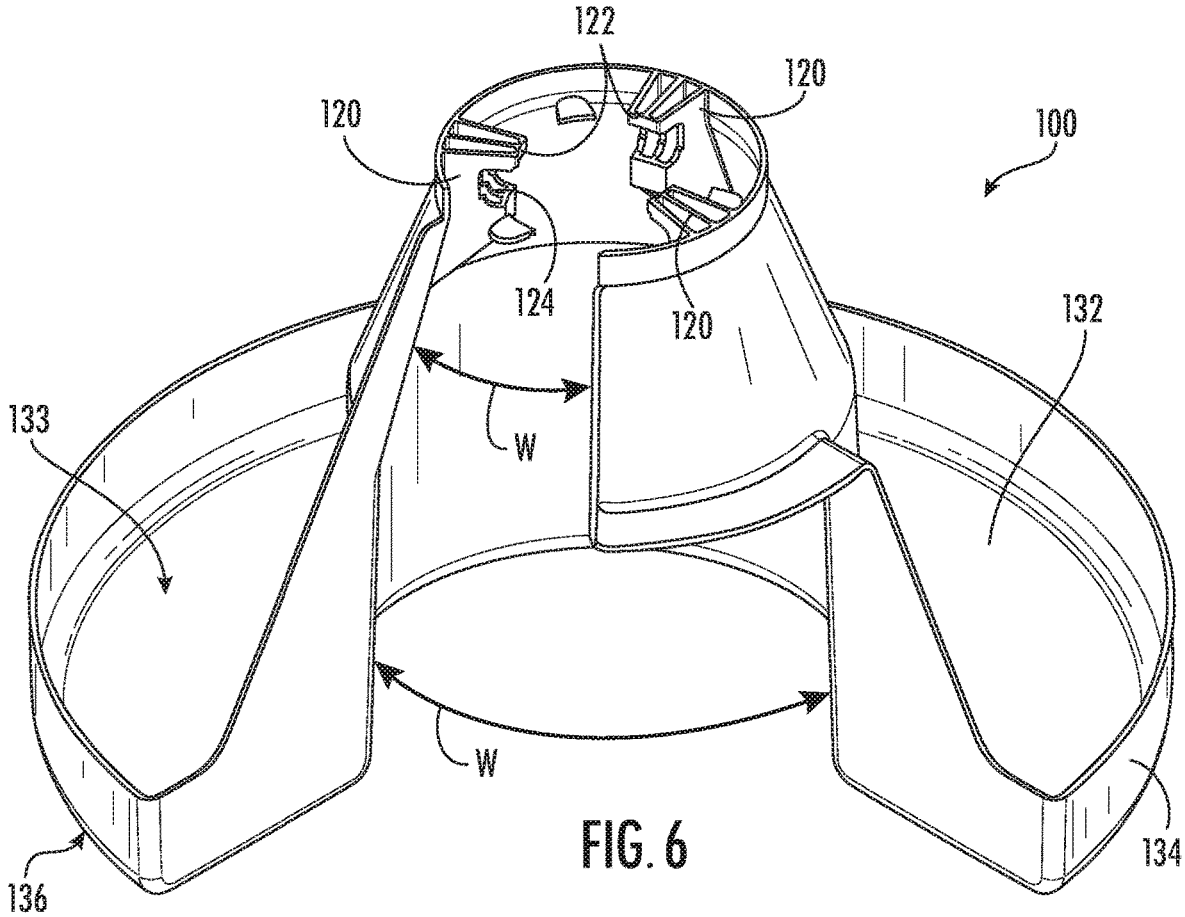
FIG. 6 is a rear perspective view of the example spacemaker of FIG. 1.
Figure 7:
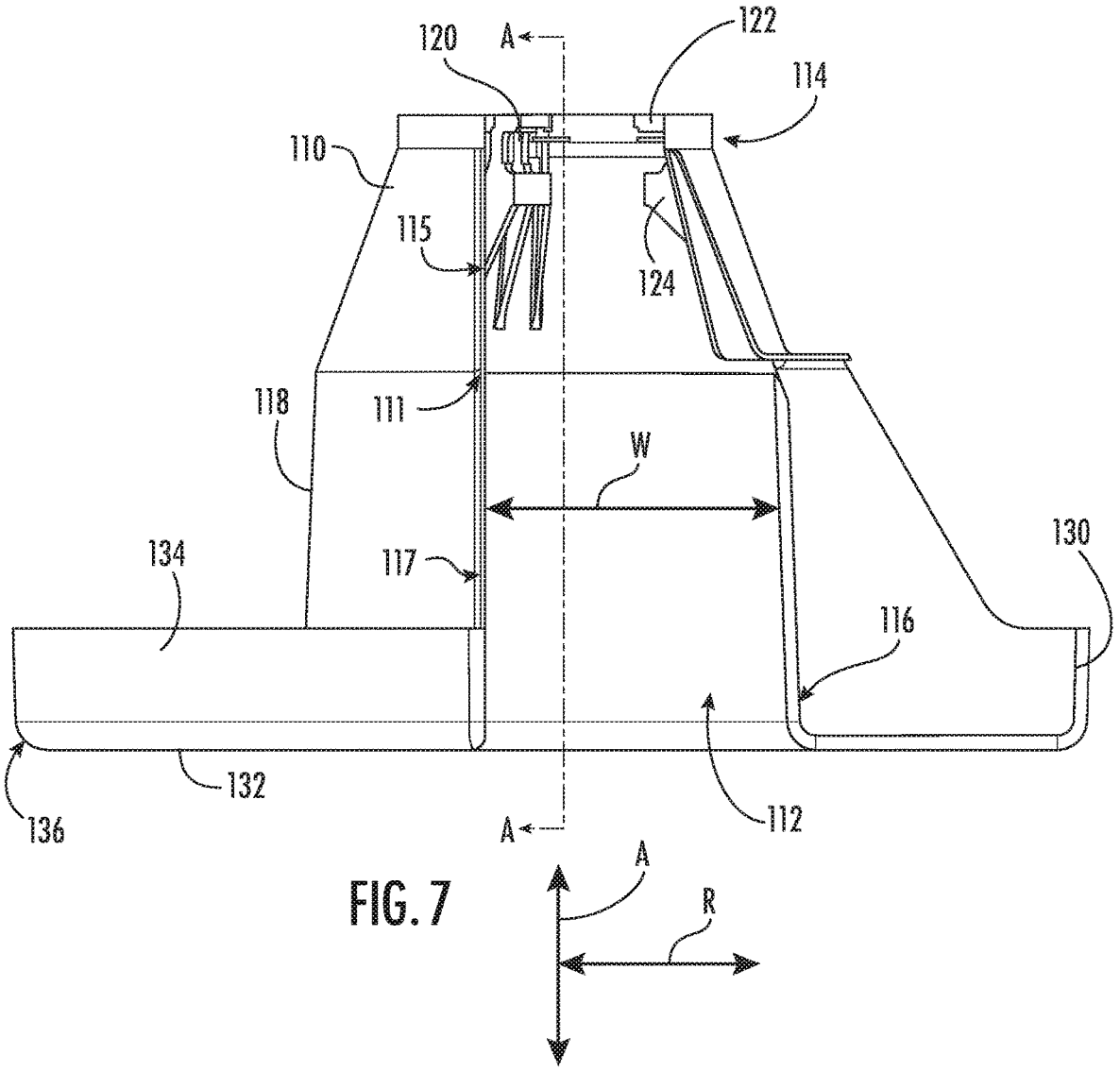
FIG. 7 is a side elevation view of the example spacemaker of FIG. 1.
Figure 8:
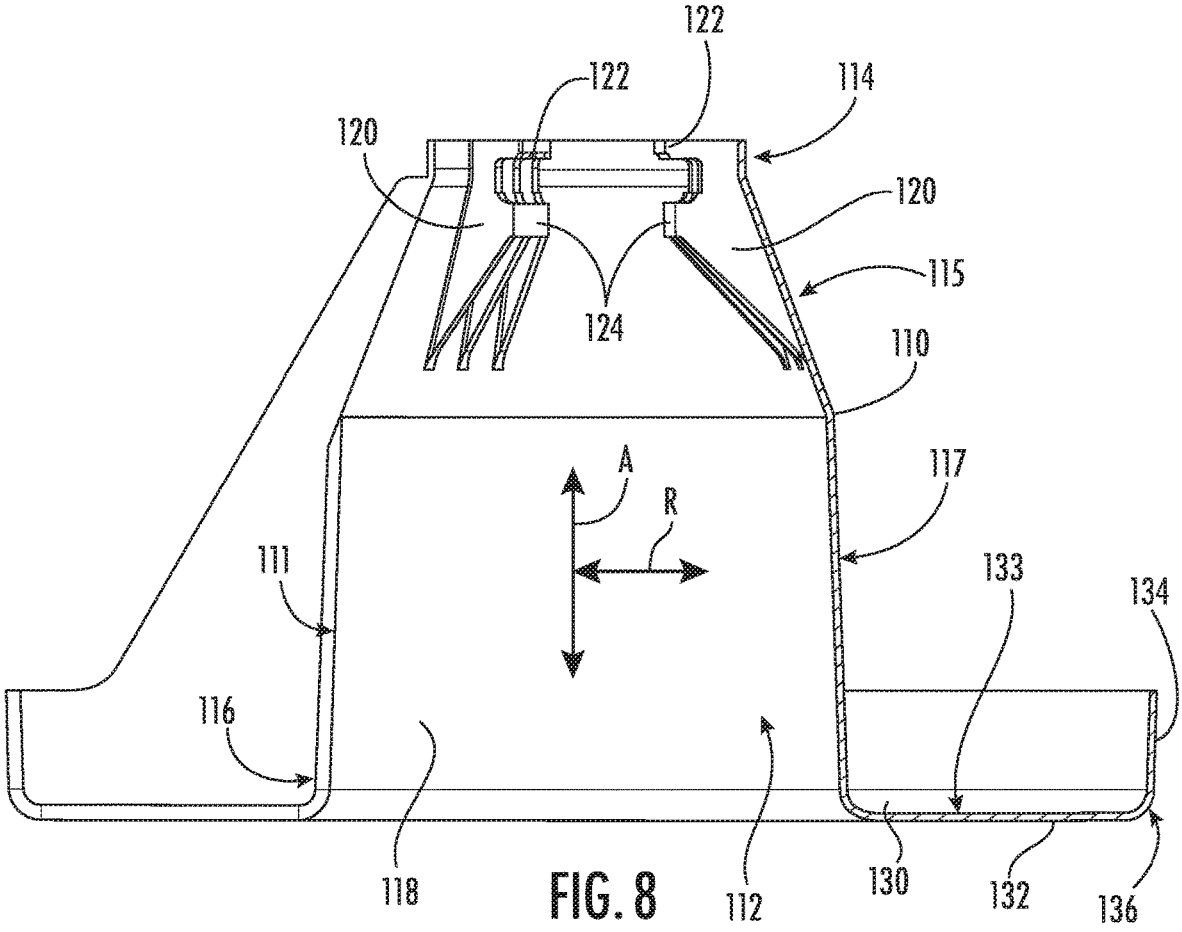
FIG. 8 is a side section view of the example spacemaker of FIG. 1 taken along the A-A line of FIG. 7.

As shown in FIG. 5, mounting bracket 44 may include an annular ring 45 with a top surface 46 and a bottom surface 48. As shown in FIG. 6, each mounting flange 120 may include a top arm 122 and a bottom arm 124. Top arm 122 of each mounting flange 120 may engage and rest on top surface 46 of annular ring 45 when spacemaker 100 is mounted to disposal 40 at mounting bracket 44. Similarly, bottom arm 124 of each mounting flange 120 may engage and rest on bottom surface 48 of annular ring 45 when spacemaker 100 is mounted to disposal 40 at mounting bracket 44.

Mounting flanges 120 may include two, three, four or more mounting flanges 120. For instance, as shown in FIG. 6, spacemaker 100 may have three mounting flanges 120, and the three mounting flanges 120 may be spaced apart, e.g., along the circumferential direction C, from one another by about one hundred and five degrees (105°) on sheath 110. Such spacing between mounting flanges 120 may advantageously allow mounting flanges 120 to slip onto annular ring 45, e.g., which may correspond to the widest portion of mounting bracket 44 along the radial direction R.

Spacemaker 100 may further include a shelf 130. Shelf 130 may be mounted to sheath 110, e.g., at bottom portion 116 of sheath 110. Shelf 130 is configured for support items, such as cleaning supplies 30, thereon. Shelf 130 may include a bottom wall 132 and/or an outer wall 134. Bottom wall 132 may extend outwardly, e.g., along the radial direction R, from sheath 110. Items for storage, such as cleaning supplies 30, may be positioned on a top surface 133 of bottom wall 132. Outer wall 134 of shelf 130 may extend upwardly, e.g., along the axial direction A, from bottom wall 132 at an outer edge 136 of bottom wall 132. Outer edge 136 may correspond to the outermost portion of bottom wall 132, e.g., along the radial direction R. Outer wall 134 may assist with containing items for storage, such as cleaning supplies 30, on bottom wall 132. For example, items sliding on bottom wall 132 may impact against outer wall 134 rather than sliding off bottom wall 132.

Spacemaker 100 may be formed of or with plastic in certain example embodiments. In addition, spacemaker 100 may be formed using injection molding, additive manufacturing, etc. Thus, e.g., sheath 110, mounting flanges 120, and shelf 130 may be integrally formed from a single piece of plastic.

Spacemaker 100 also include a locking strap 140. Locking strap 140 may extend, e.g., along the circumferential direction C, around sheath 110 at top portion 114 of sheath 110. Locking strap 140 may be cinched onto sheath 110 to assist with securing spacemaker 100 on disposal 40. Locking strap 140 may be a hose clamp, a zip tie, etc.

Spacemaker 100 may further include a light emitter 150. Light emitter 150 may be mounted to sheath 110 and/or shelf 130. Light emitter 150 may include at least one light emitting diode (LED), a battery, and/or a motion sensor. Light emitter 150 is operable to illuminate storage area 24, e.g., when the door of cabinet 20 is opened.

Figure 10:
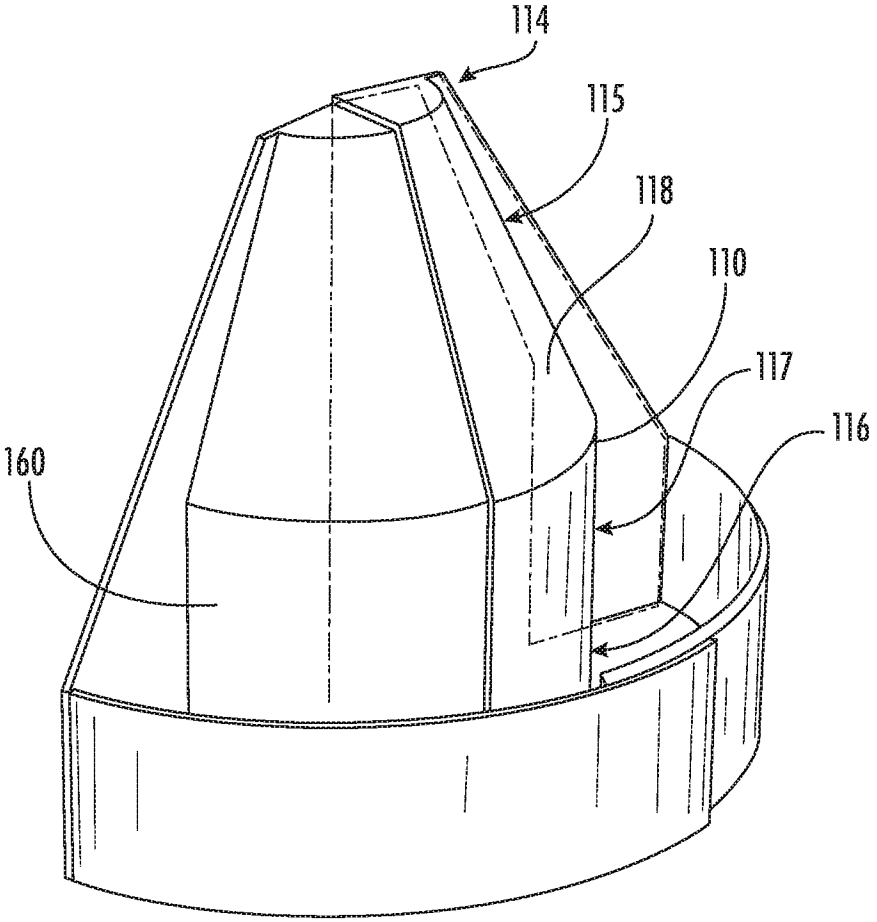
FIGS. 9 and 10 are perspective views of a shelf expander of the example spacemaker of FIG. 1.
Figure 9:
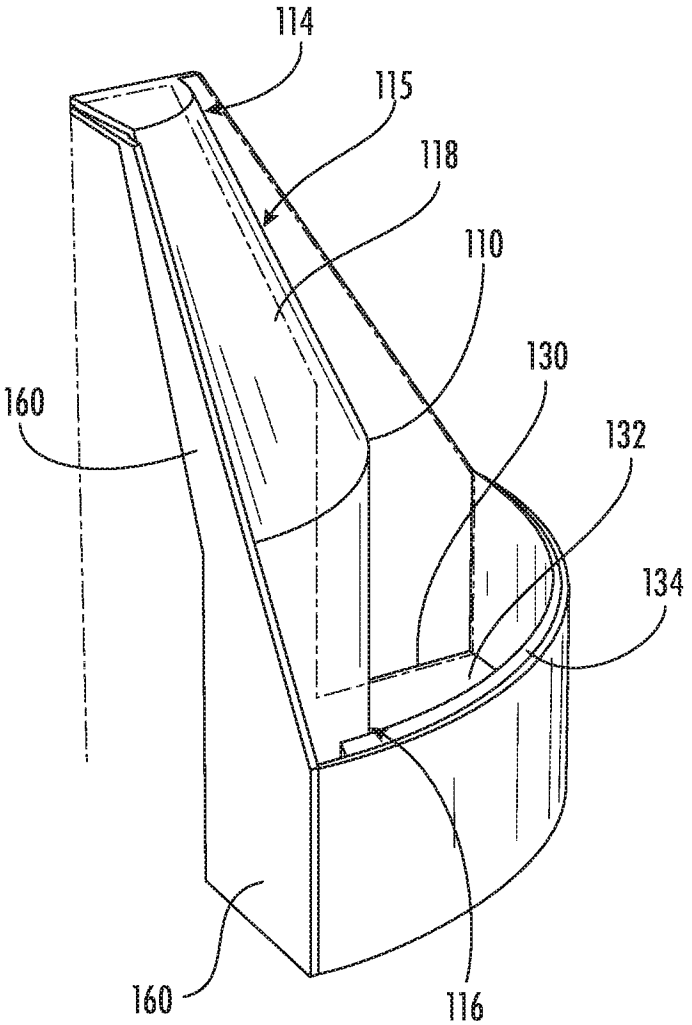

Turning now to FIGS. 9 and 10, spacemaker 100 may include a shelf expander 160, e.g., shaped and formed complementary to sleeve 110 and/or shelf 130 described above. Shelf expander 160 may be extended from the arrangement shown in FIG. 9 to the arrangement shown in FIG. 10. In particular, a shelf extension 162 of shelf expander 160 is nested on shelf 130 in a retracted configuration, as shown in FIG. 9. Conversely, shelf extension 162 of shelf expander 160 projects from shelf 130 in an extended configuration, as shown in FIG. 10. Shelf extension 162 may extend across slot 111, e.g., along the circumferential direction C, in the extended configuration to provide additional storage space on spacemaker 100.

Spacemaker 100 may advantageously allow sleeve 110 and/or shelf 130 to be mounted to any type of disposer via mounting flanges 120. In addition, spacemaker 100 may be mounted to the disposer without removing or adjusting the disposer. In certain example embodiments, spacemaker 100 may be mounted to the disposer without tools. Thus, spacemaker 100 may provide easy additional storage space on and around disposers.

Figure 11:
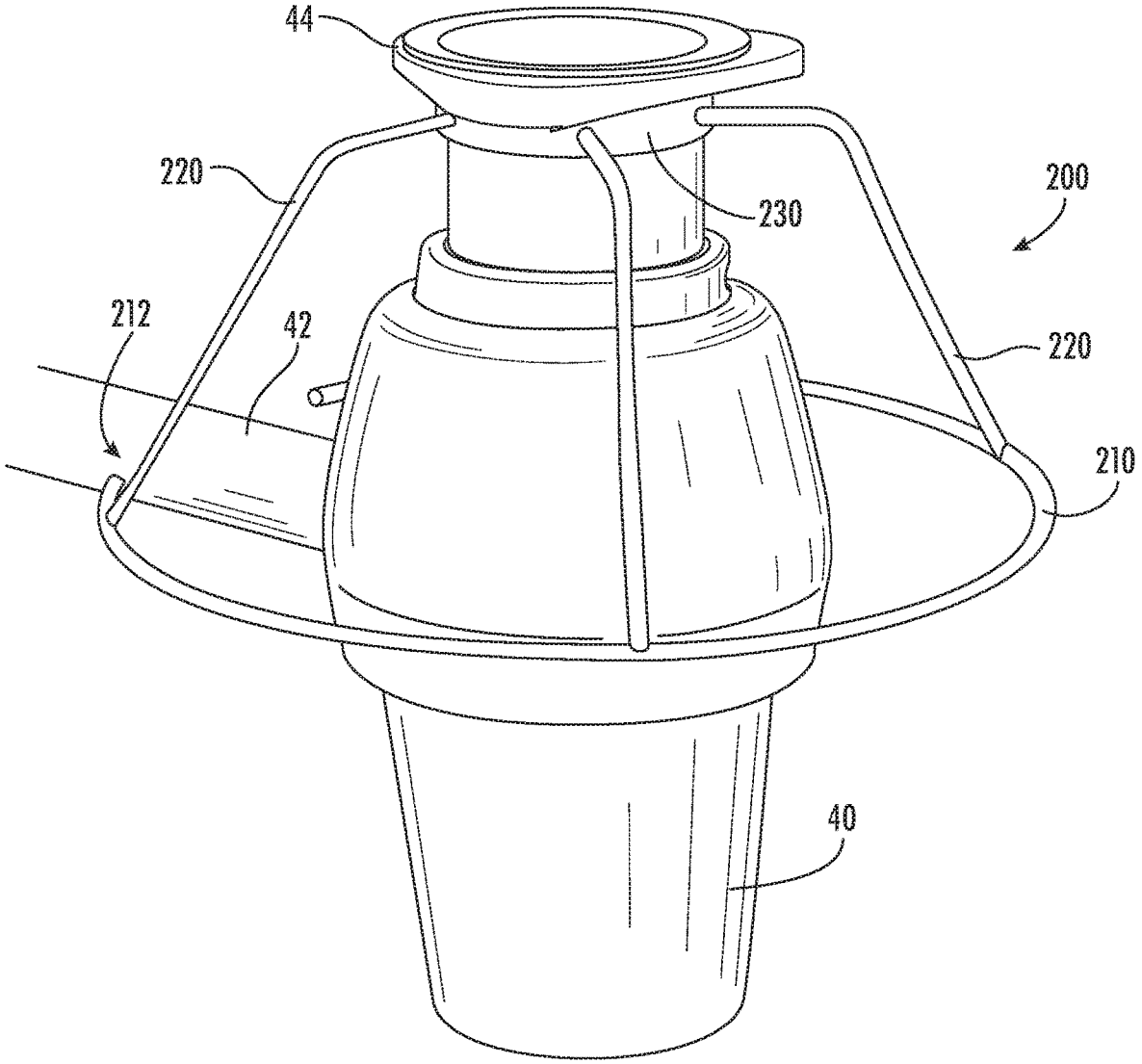
FIGS. 11 and 12 are perspective views of a spacemaker according to another example embodiment of the present subject matter.
Figure 12:
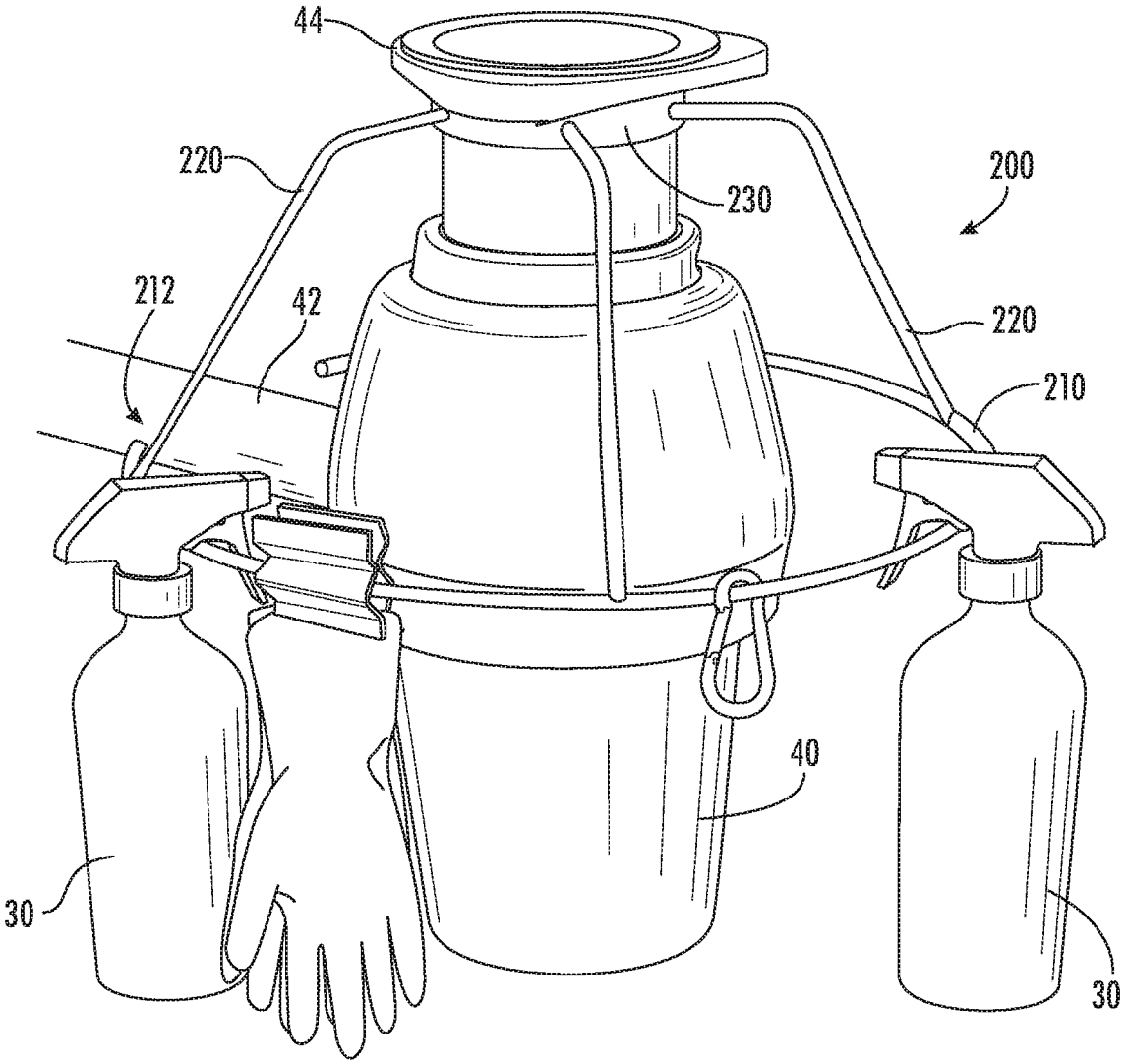

FIGS. 11 and 12 are perspective views of a spacemaker 200 according to another example embodiment of the present subject matter. Spacemaker 200 includes a sheath formed from a plurality of elongated wires 220. Like with spacemaker 100, an interior volume of sheath 220 is sized for receipt of under-sink disposal 40. A plurality of mounting flanges 230 is mounted to sheath 220 at the top portion of sheath 220. Mounting flanges 230 are configured for engaging mounting flange 44 of under-sink disposal 40 in the same or similar manner to that described above for spacemaker 100. A ring 210 is mounted to sheath 220 at the bottom portion of sheath 220. Ring 210 and sheath 220 may collectively define a slot 212 in the same or similar manner to that described above for spacemaker 100.

Figure 13:
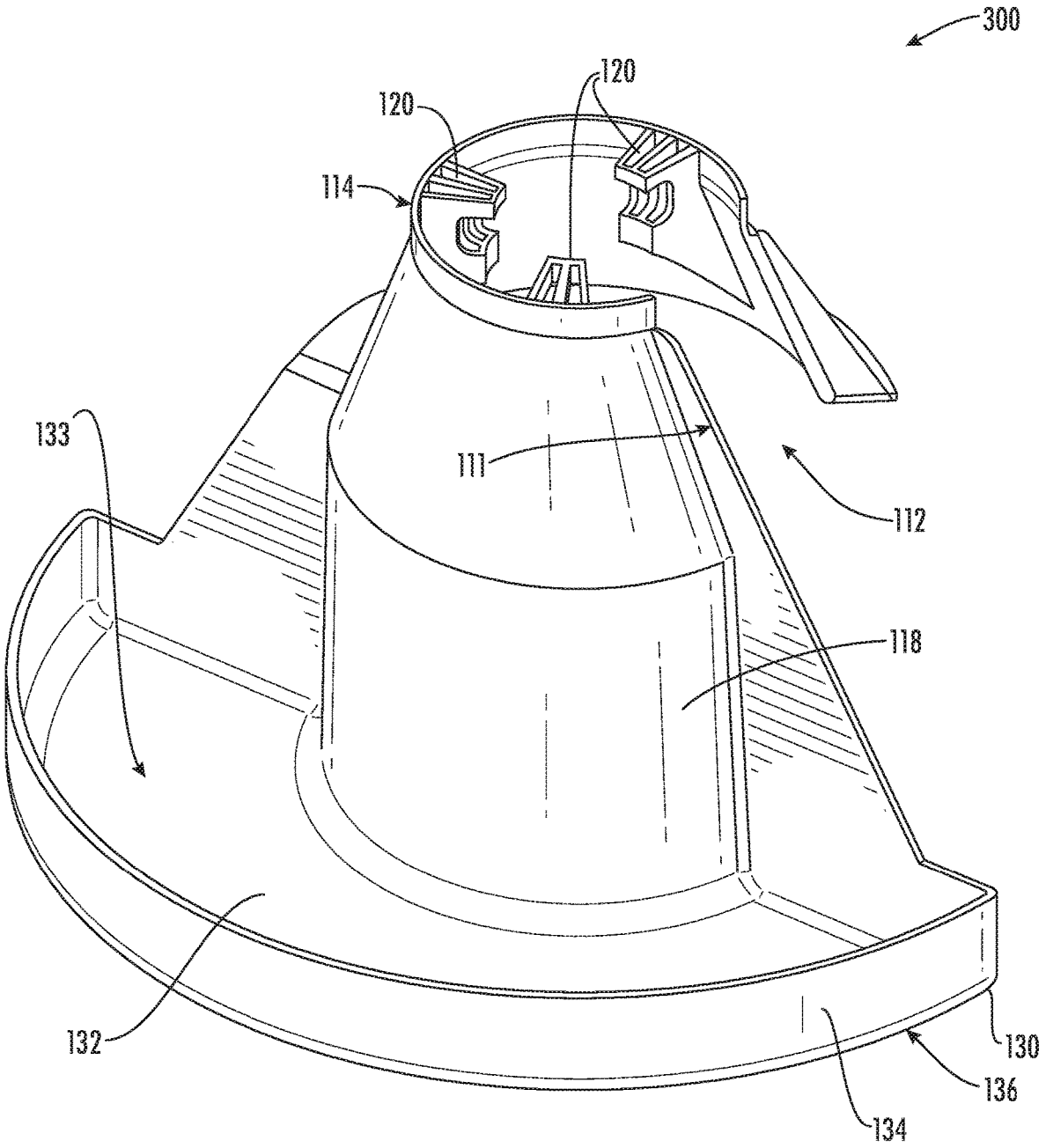
FIG. 13 is a perspective view of a spacemaker according to an additional example embodiment of the present subject matter.
Figure 14:
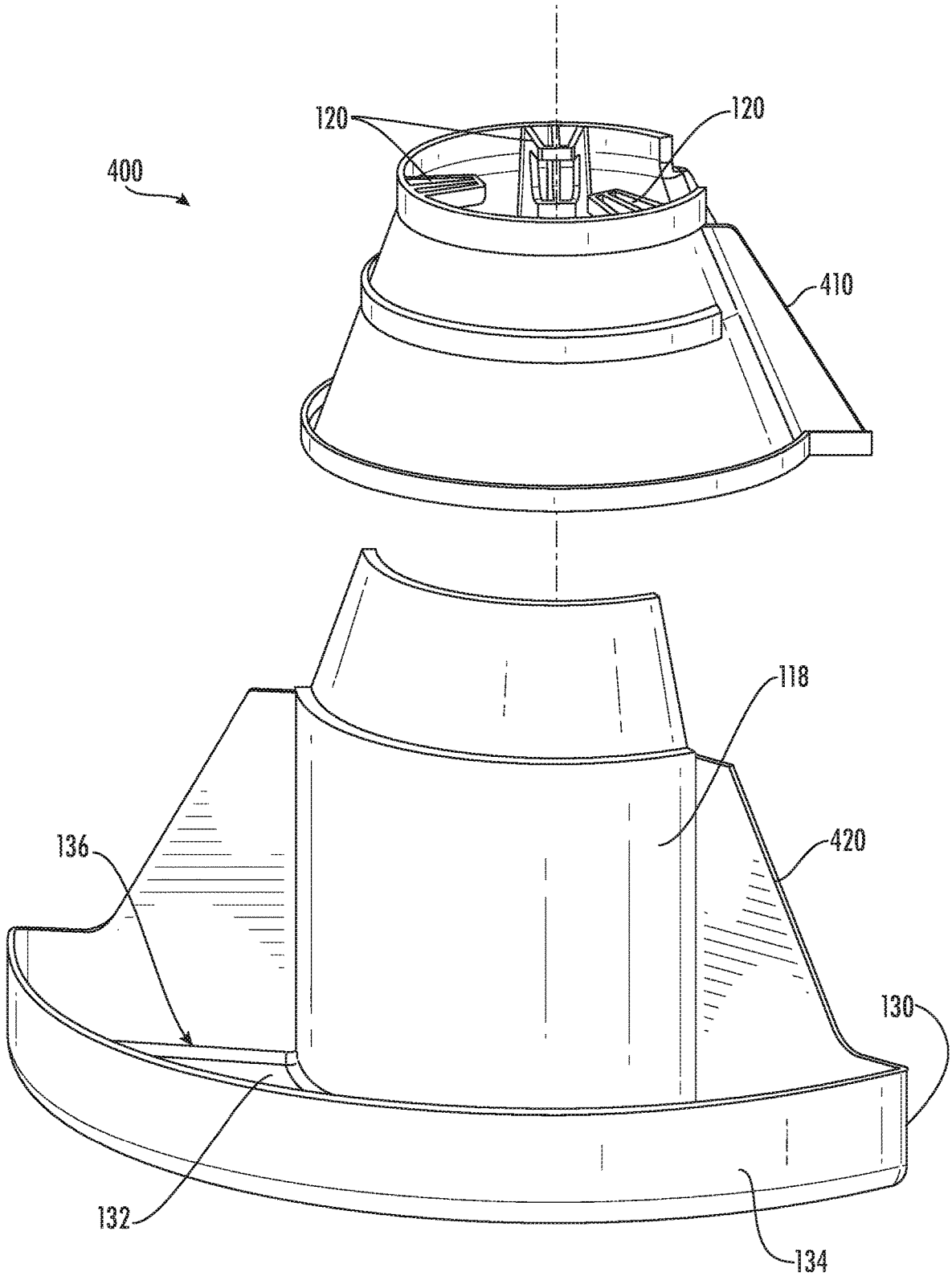
FIGS. 14 through 17 are views of a spacemaker according to a further example embodiment of the present subject matter.
Figure 15:
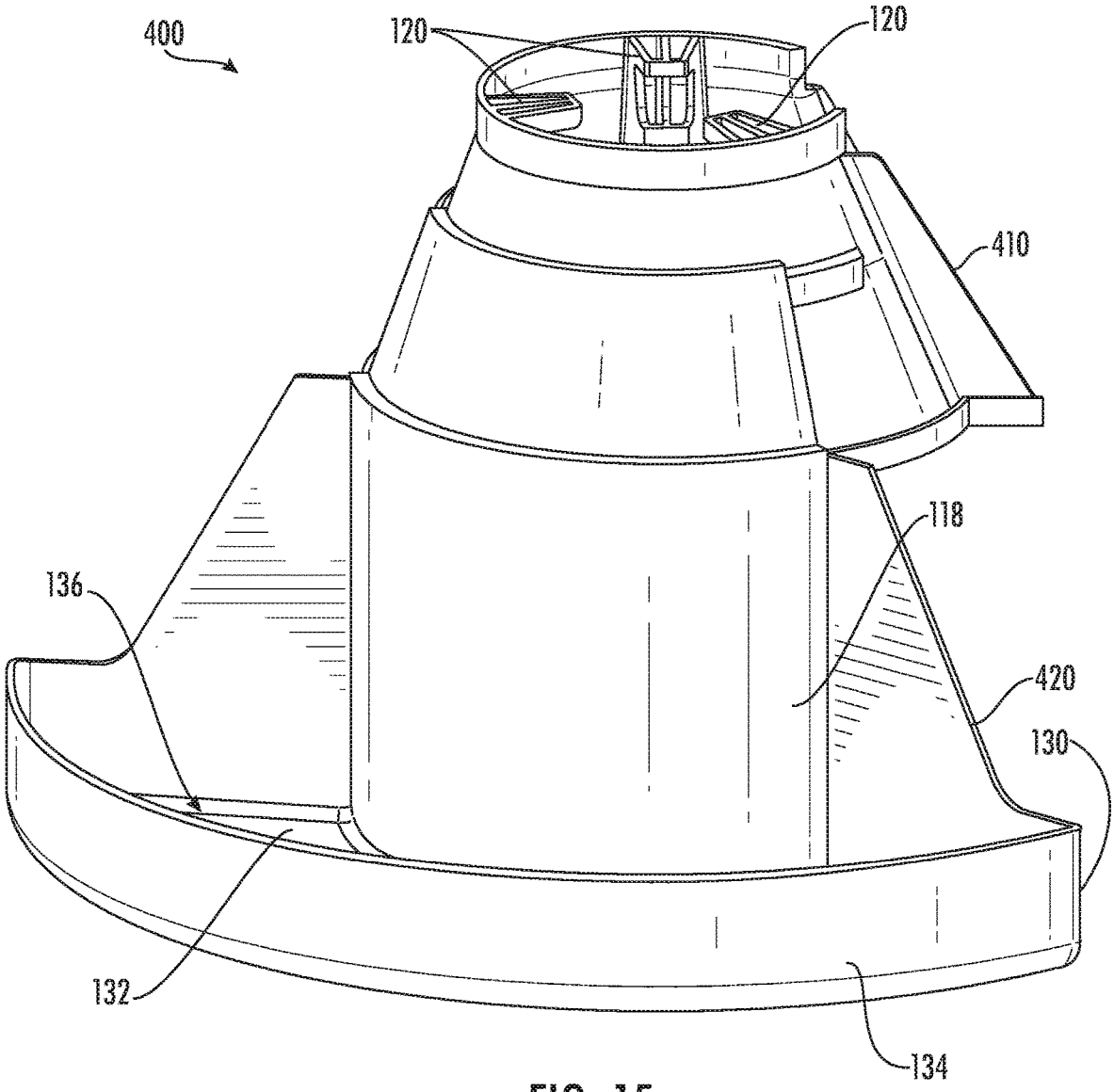

FIG. 13 is a perspective view of a spacemaker 300 according to an additional example embodiment of the present subject matter. Spacemaker 300 is formed in the same or similar manner to that described above for spacemaker 100. Thus, the description of spacemaker 100 is applicable to spacemaker 300 except when noted otherwise. As shown in FIG. 13, shelf 130 extends about one hundred and eighty degrees (180°) in spacemaker 300, less than in spacemaker 100. When utilized on a double sink, spacemaker 300 may require a left-hand or right-hand version.

Figure 16:
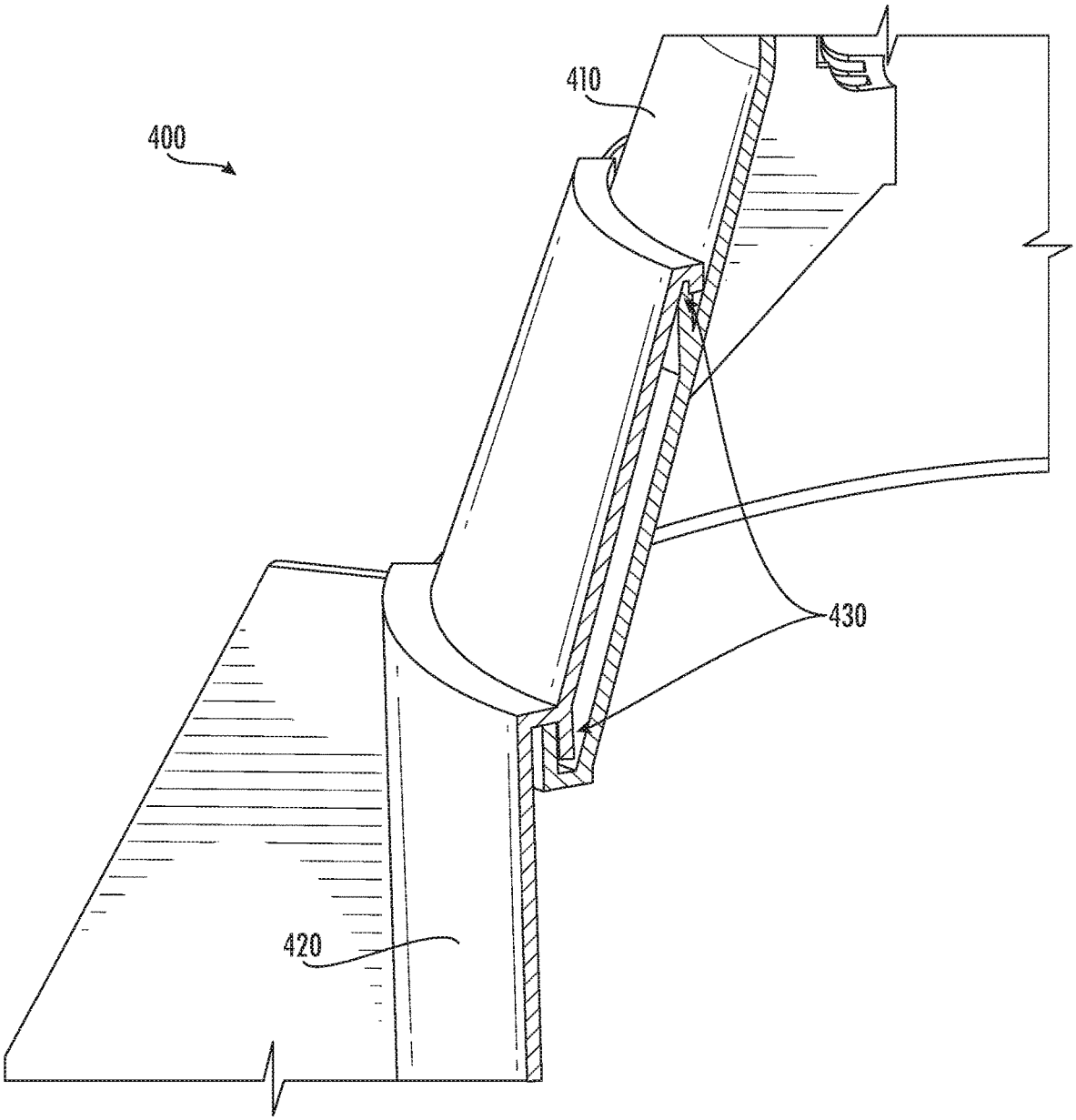
Figure 17:
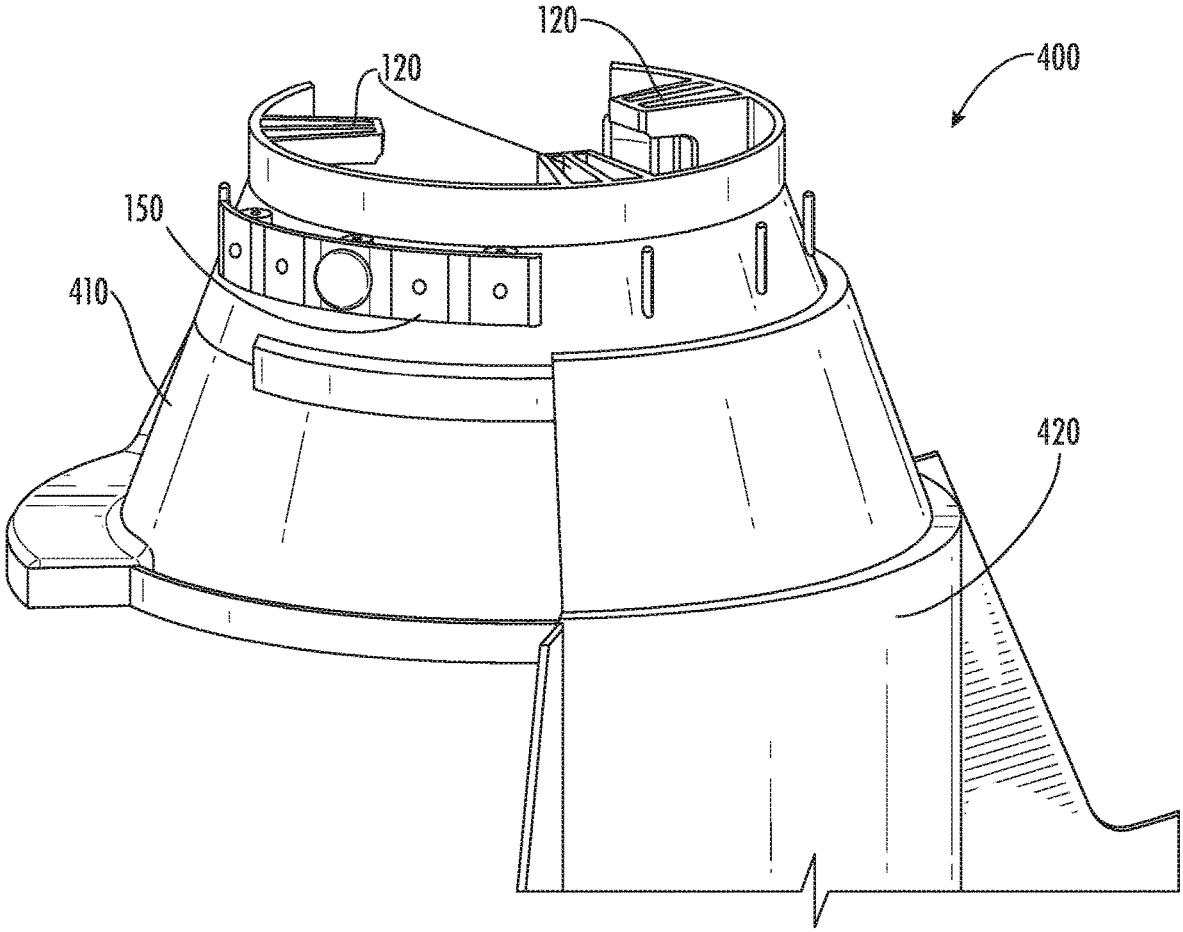

FIGS. 14 through 17 are views of a spacemaker 400 according to a further example embodiment of the present subject matter. Spacemaker 300 is formed in the same or similar manner to that described above for spacemaker 100. Thus, the description of spacemaker 100 is applicable to spacemaker 400 except when noted otherwise. As shown in FIGS. 14 through 17, spacemaker 400 is a two-piece assembly with an upper section 410 with mounting flanges 120 and a bottom section 420 with shelf 130. Upper section 410 may be mounted to mounting bracket 44 of disposal 40 with mounting flanges 120, and bottom section 420 may then be mounted to upper section 410 via an interference connection 430 (FIG. 16). Light emitter 150 may be mounted to upper section 410 or bottom section 420.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spacemaker, comprising:

a sheath defining an interior volume, the interior volume of the sheath sized such that an under-sink disposal is receivable within the interior volume of the sheath;

a plurality of mounting flanges mounted to the sheath at a top portion of the sheath, the plurality of mounting flanges configured for engaging a mounting flange of the under-sink disposal; and a shelf mounted to the sheath at a bottom portion of the sheath, wherein the sheath at least partially extends circumferentially around the under-sink disposal when the under-sink disposal is received within the interior volume of the sheath.

2. The spacemaker of claim 1, wherein the sheath defines a slot, the slot extending from the top portion of the sheath to the bottom portion of the sheath such that the interior volume of the sheath is open between the top and bottom portions of the sheath through the slot, the slot sized for insertion of the under-sink disposal into the interior volume of the sheath via the slot.

3. The spacemaker of claim 2, wherein a circumferential width of the slot is no less than about twenty degrees and no greater than about two hundred degrees.

4. The spacemaker of claim 2, wherein the slot has a first portion and a second portion, the first portion of the slot positioned at the top portion of the sheath, the second portion of the slot positioned at the bottom portion of the sheath, a circumferential width of the first portion of the slot being about forty-five degrees, a circumferential width of the second portion of the slot no greater than about ninety degrees and no less than about forty-five degrees.

5. The spacemaker of claim 1, wherein the plurality of mounting flanges comprises three mounting flanges, the three mounting flanges circumferentially spaced apart by about one hundred and five degrees on the sheath.

6. The spacemaker of claim 1, further comprising a locking strap extendable around the sheath at the top portion of the sheath.

7. The spacemaker of claim 1, wherein each of the plurality of mounting flanges extends radially inward from the sheath, each of the plurality of mounting flanges comprises a top arm and a bottom arm, and the mounting flange of the under-sink disposal is receivable between the top and bottom arms of the plurality of mounting flanges.

8. The spacemaker of claim 1, wherein a bottom wall of the shelf extends radially outward from the sheath, and an outer wall of the shelf extends upwardly from the bottom wall of the shelf at an outer edge of the bottom wall.

9. The spacemaker of claim 1, further comprising a light emitter mounted to the sheath or the shelf.

10. The spacemaker of claim 1, wherein the sheath, the plurality of mounting flanges, and the shelf are integrally formed from a single piece of plastic.

11. A spacemaker, comprising:

a sheath defining an interior volume, the interior volume of the sheath sized such that an under-sink disposal is receivable within the interior volume of the sheath;

a plurality of mounting flanges mounted to the sheath at a top portion of the sheath, each of the plurality of mounting flanges extending radially inward from the sheath, each mounting flange of the plurality of mounting flanges comprising a top arm and a bottom arm, the mounting flange of the under-sink disposal receivable between the top and bottom arms of the plurality of mounting flanges; and a shelf mounted to the sheath at a bottom portion of the sheath, a bottom wall of the shelf extending radially outward from the sheath, wherein the sheath, the plurality of mounting flanges, and the shelf are integrally formed from a single piece of plastic.

12. The spacemaker of claim 11, wherein the sheath defines a slot, the slot extending from the top portion of the sheath to the bottom portion of the sheath such that the interior volume of the sheath is open between the top and bottom portions of the sheath through the slot, the slot sized for insertion of the under-sink disposal into the interior volume of the sheath via the slot.

13. The spacemaker of claim 12, wherein a circumferential width of the slot is no less than about twenty degrees and no greater than about one hundred and eighty degrees.

14. The spacemaker of claim 12, wherein the slot has a first portion and a second portion, the first portion of the slot positioned at the top portion of the sheath, the second portion of the slot positioned at the bottom portion of the sheath, a circumferential width of the first portion of the slot being about forty-five degrees, a circumferential width of the second portion of the slot no greater than about ninety degrees and no less than about forty-five degrees.

15. The spacemaker of claim 11, wherein the plurality of mounting flanges comprises three mounting flanges, the three mounting flanges circumferentially spaced apart by about one hundred and five degrees on the sheath.

16. The spacemaker of claim 11, further comprising a locking strap extendable around the sheath at the top portion of the sheath.

17. The spacemaker of claim 11, wherein an outer wall of the shelf extends upwardly from the bottom wall of the shelf at an outer edge of the bottom wall.

18. The spacemaker of claim 11, further comprising a light emitter mounted to the sheath or the shelf.

19. A spacemaker, comprising:

a sheath defining an interior volume, the interior volume of the sheath sized such that an under-sink disposal is receivable within the interior volume of the sheath;

a plurality of mounting flanges mounted to the sheath at a top portion of the sheath, the plurality of mounting flanges configured for engaging a mounting flange of the under-sink disposal; and a ring mounted to the sheath at a bottom portion of the sheath, wherein each mounting flange of the plurality of mounting flanges includes a top arm and a bottom arm, the mounting flange of the under-sink disposal receivable between the top and bottom arms of the plurality of mounting flanges.

* * * * *